US008869699B2

(12) United States Patent
Elter et al.

(10) Patent No.: US 8,869,699 B2
(45) Date of Patent: Oct. 28, 2014

(54) METHOD OF CONTROLLING INKING UNITS IN CASE OF PRINTING SPEED CHANGES

(75) Inventors: Peter Elter, Mühlhausen (DE); Alexander Knabe, Heidelberg (DE); Nikolaus Pfeiffer, Heidelberg (DE); Wolfgang Schönberger, Schriesheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 173 days.

(21) Appl. No.: 13/565,988

(22) Filed: Aug. 3, 2012

(65) Prior Publication Data

US 2013/0032052 A1 Feb. 7, 2013

(30) Foreign Application Priority Data

Aug. 3, 2011 (DE) ..... 10 2011 109 360

(51) Int. Cl.

| | |
|---|---|
| ***B41F 13/22*** | (2006.01) |
| ***B41F 31/00*** | (2006.01) |
| ***B41F 33/00*** | (2006.01) |
| ***B41F 7/02*** | (2006.01) |
| ***B41F 7/06*** | (2006.01) |

(52) U.S. Cl.

CPC ..... *B41F 7/025* (2013.01); *B41F 33/00* (2013.01); *B41F 7/06* (2013.01); *B41F 33/0036* (2013.01)

USPC ..... 101/484; 101/487

(58) Field of Classification Search

CPC .. B41F 13/22; B41F 33/0036; B41F 33/0009; B41F 33/00; B41F 31/002; B41F 31/004; B41P 2233/10; B41P 2200/21

USPC ..... 101/484, 487

See application file for complete search history.

(56) References Cited

U.S. PATENT DOCUMENTS

| | | | |
|---|---|---|---|
| 7,004,070 | B2 | 2/2006 | Schneider et al. |
| 7,021,215 | B2 | 4/2006 | Schneider et al. |
| 7,089,855 | B2 | 8/2006 | Schneider et al. |
| 7,143,695 | B2 | 12/2006 | Schneider et al. |
| 7,261,034 | B2 | 8/2007 | Schneider et al. |
| 7,409,910 | B2 | 8/2008 | Schneider et al. |
| 7,515,267 | B2 | 4/2009 | Ehbets et al. |
| 7,884,926 | B2 | 2/2011 | Engler et al. |
| 7,894,065 | B2 | 2/2011 | Kohlbrenner et al. |
| 8,127,672 | B2 | 3/2012 | Mueller et al. |
| 2011/0088577 | A1 | 4/2011 | Berti et al. |

FOREIGN PATENT DOCUMENTS

| | | | |
|---|---|---|---|
| DE | 10254501 | A1 | 5/2004 |
| DE | 102008001309 | A1 | 8/2009 |
| DE | 102010046957 | A1 | 4/2011 |

*Primary Examiner* — Leslie J Evanisko

(74) *Attorney, Agent, or Firm* — Laurence A. Greenberg; Werner H. Stemer; Ralph E. Locher

(57) ABSTRACT

A method controls a printing speed and a temperature of a printing press to attain a predetermined actuating variable. The printing press includes a control computer. The method is characterized by calculating a target temperature to attain the predetermined actuating variable at a desired printing speed and initiating the adjustment operations to attain the target temperature by the control computer. The actual printing speed is changed via a first acceleration within a tolerance limit with respect to fluctuations about the predetermined actuating variable. The first acceleration process is stopped if the desired printing speed is attained in the process. The first acceleration is changed if the tolerance limits are reached and the desired printing speed has not been attained yet. The printing speed is ran at a modified second acceleration along the tolerance limits until the desired printing speed is attained.

10 Claims, 9 Drawing Sheets

METHOD OF CONTROLLING INKING UNITS IN CASE OF PRINTING SPEED CHANGES

CROSS-REFERENCE TO RELATED APPLICATION

This application claims the priority, under 35 U.S.C. §119, of German application DE 10 2011 109 360.9, filed Aug. 3, 2011; the prior application is herewith incorporated by reference in its entirety.

BACKGROUND OF THE INVENTION

Field of the Invention

The present invention relates to a method of controlling the printing speed and temperature of a printing press to attain a predetermined actuating value, the printing press has a control computer.

In lithographic offset printing presses, ink is generally metered in the printing unit by an inking unit that includes a number of ink zones. Each ink zone includes an ink key for adjusting the required openings and thus the amount of ink. However, there are also inking units referred to as short inking units, in particular anilox inking units, which do not include ink zones and ink keys for zonal metering. Therefore, in printing presses that have short inking units, the amount of ink cannot be metered by opening or closing zonal metering elements. Instead, other variables need to be influenced. A known fact is that in offset presses, ink metering and thus the coloration of the printed product depends on the temperature and the printing speed of the press. Thus it is possible to use temperature changes and printing speed changes to adjust the coloration in offset printing presses that have an anilox inking unit. In general, however, the press operator wants to set a certain printing speed to produce a desired number of printed products in a specified time. Consequently, the desired target temperature for the desired printing speed needs to be calculated and attained. A problem with adjusting the inking unit temperature is, however, that the inking unit only reacts sluggishly to temperature changes; it takes much longer to attain a desired temperature than to change the printing speed.

The relationship between temperature and printing speed is known from published, non-prosecuted German patent application DE 102 54 501 A1, corresponding to U.S. Pat. Nos. 7,409,910, 7,261,034, 7,143,695, 7,089,855, 7,021,215, and 7,004,070. In accordance with the method of operating a rotary printing press disclosed therein, the inking unit temperature is set as a function of the printing speed.

Published, non-prosecuted German patent application DE 10 2008 001 309 A1, corresponding to U.S. Pat. No. 8,127,672, discloses a method that is intended to ensure that the ink density on the printed product remains constant by actuating printing speed and temperature in the inking unit in a matching way. The intention is to ensure that the dynamics of the speed progression and the dynamics of the temperature progression are better matched with each other to attain a static ink curve relationship even for dynamic cases. Color measurement devices are known from U.S. Pat. No. 7,884,926 B2, U.S. Pat. No. 7,894,065 B2, and U.S. Pat. No. 7,515,267 B2.

A problem of the prior art solutions is, however, that due to the sluggish temperature change, the printing speed can only be changed very slowly to maintain approximately constant coloration. Another problem is that the speed is changed in steps, resulting in a change of sign of the driving forces, which has a negative effect on the printed image.

SUMMARY OF THE INVENTION

An object of the present invention is to provide a method of controlling the printing speed in short inking units in lithographic offset presses wherein quick speed changes are possible with as little effect on the coloration as possible.

The method of the invention is particularly suited for actuation in offset printing presses that include anilox inking units without zonal ink metering devices. However, the method may likewise be used for printing presses that have zonal inking units. The process implemented upon a printing speed change is carried out in a fully automatic way by a control computer that also controls the temperature in the press. The desired actuating variable is preferably the desired or target coloration. However, the desired actuating variable may also be another actuating variable of the press that is dependent on the temperature. The temperature itself may also be the actuating variable. All these actuating variables that are dependent on the temperature are subject to the problem that temperature changes develop very slowly, causing temperature-dependent variables to quickly influence the condition of the press. This particularly applies to setting the desired target coloration to produce printed products in the press that have the same colors as the original. In accordance with the present invention, the control computer calculates the required target temperature that is necessary to attain the predetermined actuating variable at a desired printing speed. Thus a suitable target temperature is calculated for the desired colors and the desired printing speed in the inking unit of the printing press. Then the control computer initiates the required actuating processes in the press to get from the actual value of the actuating variable to the calculated target value of the actuating variable. When adjusting the desired coloration, measures need be taken to ensure that color changes are invisible or just tolerable to avoid the production of unsalable waste during an adjusting process. For this purpose, appropriate tolerance limits are stored in the control computer of the press. Until these tolerance limits are reached, the press can continue to run at the maximum acceleration. If the desired printing speed is attained during this acceleration, the acceleration process is stopped and the printing operation is continued at the desired printing speed that has been attained. If, however, the tolerance limits are reached before the desired printing speed is attained, the amount of the acceleration is reduced to an amount that does not cause change to the actuating variable, in particular the target coloration, within the tolerances. The printing press will then be accelerated to the desired speed along the tolerance limits until the desired printing speed is reached.

A great advantage of this method is that the desired printing speed is reached as quickly as possible by applying the maximum possible acceleration while ensuring that the desired actuating variable remains within acceptable tolerances, i.e. for instance without deviating from the desired target coloration. Thus a speed change does not create any spoilt products. The target coloration is preferably a desired ink density provided by prepress department based on the digital original.

In accordance with one embodiment of the invention, properties of the press, properties of the ink to be used and properties of the printing material are taken into account by the control computer in the calculation of the acceleration and the desired printing speed. Factoring in the properties of the ink such as its tackiness and viscosity is an important aspect for the adjustment of the target coloration in particular. The properties of the press such as its sensitivity to temperature likewise need to be considered. Temperature thresholds for the definition of tolerances in particular depend on the properties of the ink, of the press, and of the printing material.

In accordance with a further embodiment of the invention, the respective acceleration may be constant. Alternatively, provision may be made for the acceleration to be changed in steps by the control computer. In the constant-acceleration embodiment, the press is initially accelerated at maximum acceleration up to the tolerance limit and is then accelerated along the tolerance limit at the maximum possible acceleration. In both cases, the acceleration is constant. In accordance with an alternative embodiment of the invention, the control computer calculates acceleration steps and the press is accelerated in steps within the tolerances, with tolerance limits being the upper limits of the acceleration steps so that the acceleration steps are not outside the acceptable tolerance limits.

In accordance with a further embodiment of the invention, the tolerances are selected in a way to create color fluctuations that are just within tolerable limits. This is an alternative to the selection of tolerance limits that do not result in any visible color fluctuations when they are reached. In some printed products that do not require top printing quality, slight visible color fluctuations are acceptable. For such jobs, it is possible to sell printed products that have acceptable color fluctuations. Consequently, tolerances may be greater, the acceleration may be increased, and the desired printing speed may be reached sooner.

In accordance with yet a further embodiment of the invention, during the adjusting process, a target acceleration may be defined as a function of the temperature of the press instead of target speeds. If the drive motor of the press is actuated in this way, instead of respective target speeds, a torque for a target acceleration is defined and transmitted to the drive motor during the acceleration process and the motor is operated at this acceleration.

Other features which are considered as characteristic for the invention are set forth in the appended claims.

Although the invention is illustrated and described herein as embodied in a method for controlling inking units in case of printing speed changes, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
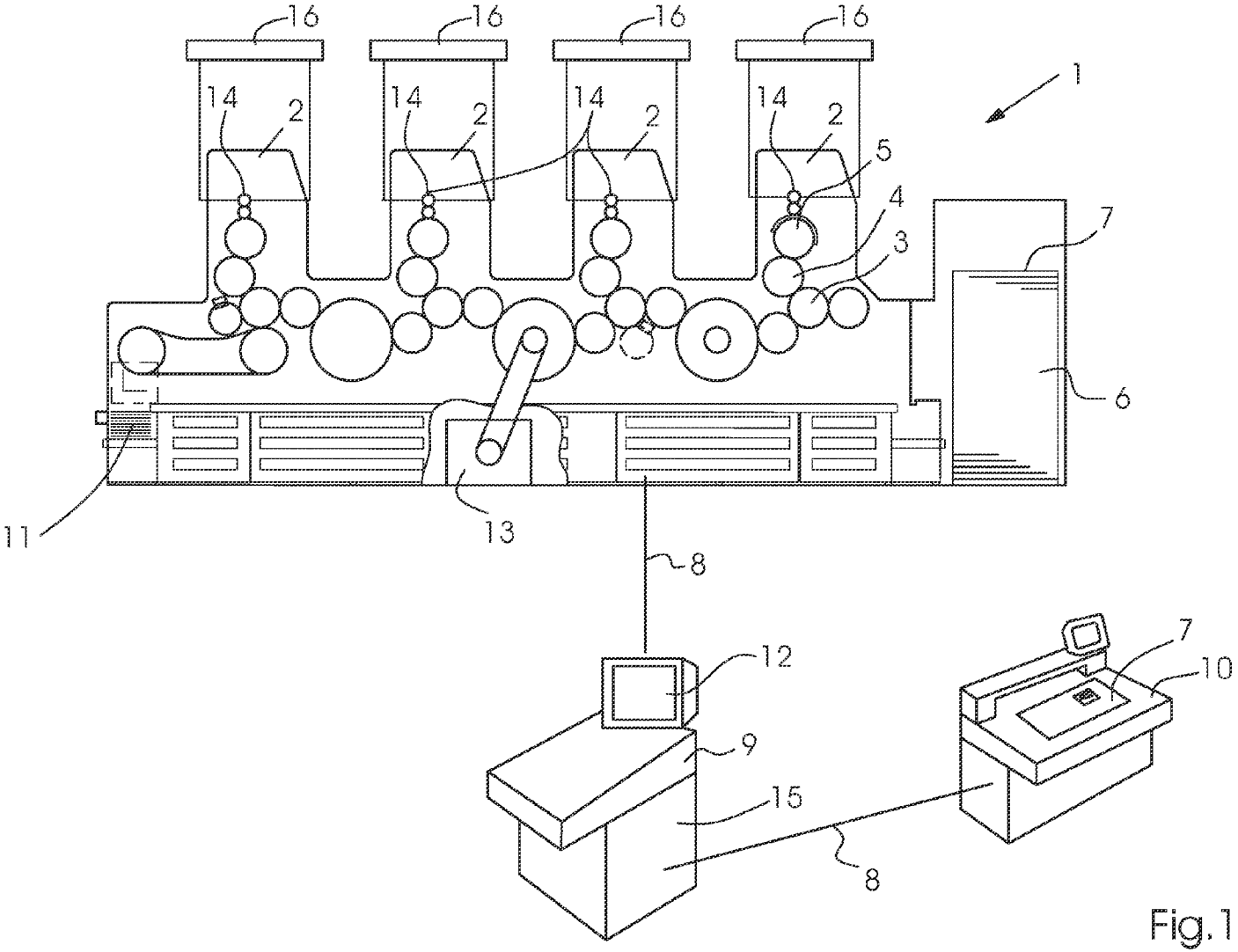
FIG. 1 is a diagrammatic, illustration of a sheet-fed rotary lithographic multicolor offset printing press including short inking units and a control computer according to the invention.

The present invention is particularly suited for controlling coloration in zoneless lithographic offset printing presses 1 including short anilox inking units 14. Such short anilox inking units 14 are used in sheet-fed offset printing presses 1 as well as in web-fed rotary printing press in particular in the field of newspaper printing. By way of example, FIG. 1 illustrates a four-color sheet-fed anilox offset printing press 1 including four printing units 2. In principle, all printing units 2 are of similar construction: each includes a plate cylinder 5 carrying a printing plate of the respective color separation, a blanket cylinder 4 for transferring the ink from the plate cylinder to printing material 7 and an impression cylinder 3. The impression cylinder 3 and the blanket cylinder 4 form a printing nip. Each printing unit 2 further includes an inking unit 14 embodied as a short anilox inking unit. The inking units 14 generally consist of screen rollers and ink applicator rollers. In addition, each printing unit 2 has a temperature control circuit 16 for separate adjustment of the printing ink temperature in the individual inking units 14.

Like all other electrically adjustable machine components, the temperature control circuits 16 are connected to a control computer 15. All printing units 2 are connected by a non-illustrated mechanical gear train and are driven by a common drive motor 13. The sheet-shaped printing material 7 is taken from a feeder 6 and fed to the first printing unit of the sheet-fed offset printing press 1. When the sheets 7 have successively passed through the four printing units 2 to receive the four color separations in the process colors black, cyan, magenta, and yellow, the printed sheets 7 are deposited in a delivery 11. In addition to being connected to the printing press 1, the control computer 15 is also connected to a color measuring device 10 by a communication link 8. Test sheets 7 taken from the delivery 11 can be placed on the color measuring device 10 to be colorimetrically examined. The actual color values that are established in this way are transmitted to the control computer 15 by the communication link 8 and are compared to the target values obtained from the prepress department based on the original. If the control computer 15 detects unacceptable deviations between actual color values and target color values, a coloration difference that needs to be corrected is diagnosed. For this purpose, the control computer 15 calculates the temperature change required for each inking unit 14 and the required speed change for a speedy compensation of the detected coloration differences.

To change the speed, the control computer 15 emits a corresponding control signal to a drive motor 13 of the sheet-fed offset printing press 1 via the communication line 8. Since the sheet-fed offset printing press 1 only has one drive motor 13, a speed change for the purpose of changing coloration can only be implemented in all printing units 2 at the same time. Changing the temperature offers more options because every printing unit 2 has its own temperature control circuit 16 that can be individually actuated by the control computer. Thus each anilox inking unit 14 can be heated or cooled separately as needed. The press 1 is operated using a screen 12 embodied as a touch screen, disposed on a control console 9, and is connected to the control computer 15. If desired, the operator of the press 1 may make coloration changes by hand using the touch screen 12.

Figure 2:
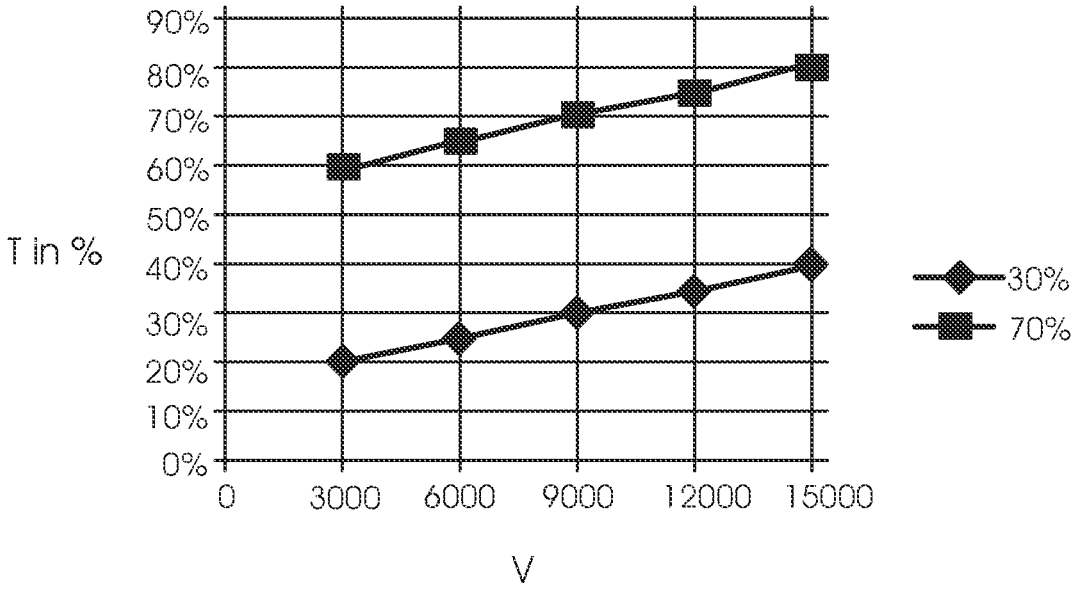
FIG. 2 is a graph for illustrating a speed compensation principle in offset printing presses.

FIG. 2 illustrates a desired target temperature $T_{Soll}$ in percent in dependence on the printing speed V in sheets/hour. The temperature $T_{Soll}$ is given in percent of a minimum temperature and to a maximum temperature. In FIG. 2, the temperature $T_{Soll}$ associated with a constant printing speed V corresponds to a desired coloration in percent on a printed sheet 7. FIG. 2 shows that a desired target coloration of 30% of the maximum coloration at a printing speed V=3,000 sheets/hour corresponds to a target temperature of 20%. For a printing speed V=6,000 sheets/hour and a desired target coloration of 30% the target temperature is 25%, for a printing speed V=9,000 sheets/hour and a target coloration of 30% the target temperature is 30%, for a printing speed V=12,000 sheets/hour and a coloration of 30% the target temperature is 35% and at a speed V=15,000 sheets/hour and a 30% coloration the target temperature is 40%. The line above this line in FIG. 2 represents the relationship between the target temperature T and the printing speed V for a coloration of 70%. In this case, the target temperature for a printing speed V=3,000 sheets/hour is 60%. At a speed V=15,000 sheets/hour, the line intersects a target temperature value of 80%.

For each target temperature $T_{soll}$ there are temperature thresholds below which no visible color fluctuations will occur if the printing speed changes and temperature thresholds below which color fluctuations are just tolerable though visible. The two thresholds may be determined by experimental printing or by model calculations. The temperature thresholds are ink-dependent and material-dependent; however, they may be given as a mean value for one class of inks and materials.

Figure 3:
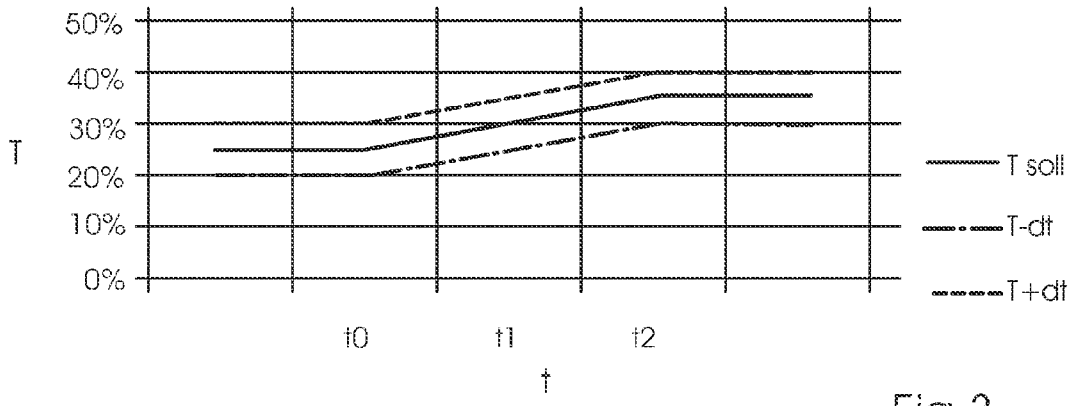
FIG. 3 is a graph for illustrating a temperature progression over time and associated temperature tolerance limits for coloration.

The central graph of FIG. 3 represents the progression of the desired temperature $T_{Soll}$. Above and below this graph, tolerance limits are indicated. These limits correspond to the values T+dT and T−dT, which are the upper and the lower temperature limit, respectively, that indicate coloration changes that are just acceptable. In FIG. 3, dT is assumed to be 5%. The printing press 1 is started up in such a way that the printing speed V is changed in a way to ensure that the temperature $T_{Soll}$ stays within temperature limits T+dT and T−dT. The deviation dT is calculated in the control computer 15 based on the target temperature $T_{Soll}$ and on the target printing speed $V_{Soll}$.

Figure 4:
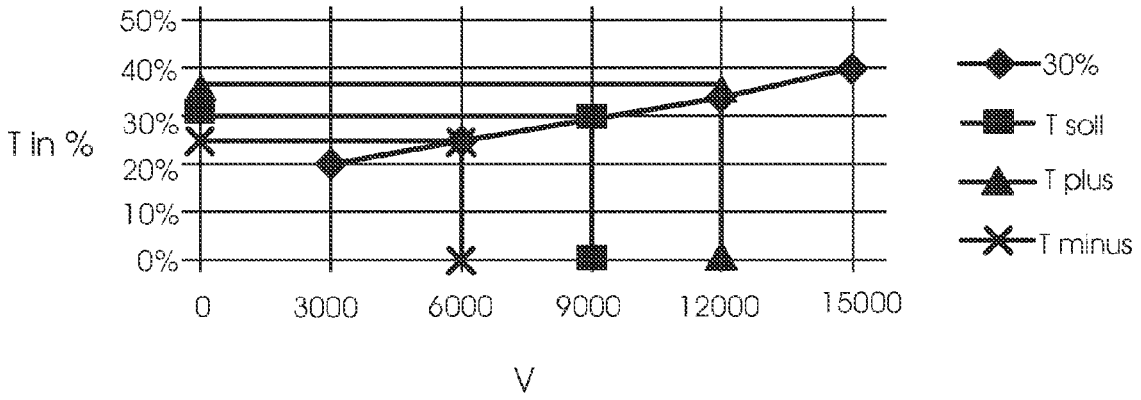
FIG. 4 is a graph for illustrating the relationship between printing speed and temperature and the associated tolerance limits for the coloration.

FIG. 4 illustrates the development of the 30% coloration line in dependence on the printing speed V, the set temperature value T in % and the upper and lower limits $T_{PLUS}$ and $T_{MINUS}$. The following speed change rules are derived from these temperature limits: if the target printing speed $V_{Soll}$ is between the acceptable limits $V_{min}$ and $V_{max}$, which are associated with the temperature limits $T_{PLUS}$ and $T_{MINUS}$, the printing press 1 may immediately be accelerated to the target printing speed $V_{Soll}$. If the current printing speed $V_{lst}$ is below the upper limit $V_{max}$, which is in turn below the target printing speed $V_{Soll}$, the printing press will initially be accelerated to $V_{max}$ and then slowly to $V_{Soll}$. If both the actual printing speed $V_{lst}$ and the desired printing speed $V_{Soll}$ are above speed $V_{max}$, the current printing speed $V_{lst}$ is maintained until the coloration is within the tolerances again.

If the current printing speed $V_{lst}$ is greater than $V_{min}$ and greater than $V_{Soll}$, the press is decelerated to printing speed $V_{min}$. If printing speed $V_{min}$ is greater than $V_{lst}$ and greater than $V_{Soll}$, printing speed $V_{lst}$ is maintained in the press until the coloration is within the tolerances again. When all these settings are completed, if required, the respective printing speed V is slowly accelerated towards the target speed $V_{Soll}$ within the temperature limits and the speed limits as a function of the temperature T. As a result, the printing press 1 reaches the target speed $V_{Soll}$ as quickly as possible with the color deviations remaining within the tolerances. The actual speed $V_{lst}$ is maintained as long as it takes for the temperature $T_{lst}$ to reach a level that permits further printing speed changes towards the target speed $V_{Soll}$. As an alternative to such a slow continuous change of the printing speed V, the printing speed V may be changed in steps, for example in steps of 1,000 sheets/hour. Another alternative is to accelerate more slowly from the start. However, this would prolong the dynamic condition.

Figure 5:
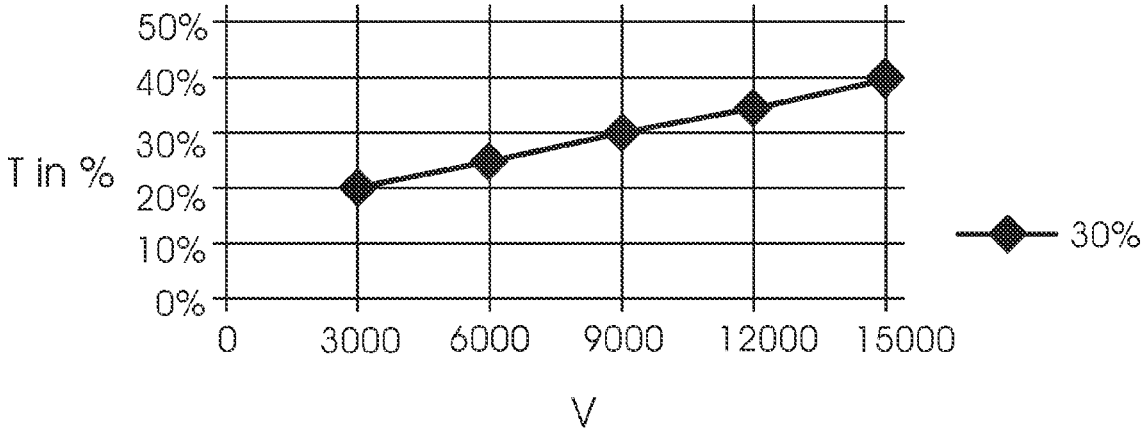
FIG. 5 is a graph for illustrating an increase of the printing speed from 6,000 to 12,000 sheets per hour with identical coloration.

In FIG. 5, a first exemplary development of the temperature T in % is shown as a function of the printing speed V, which is increased from 6,000 sheets/hour to 12,000 sheets/hour. In the process, the target coloration value is to remain unchanged at 30% from the beginning to the end. The initial temperature at $V_{lst}$=6,000 sheets/hour is $T_{lst}$=25%, and the temperature tolerance limits are 5%. This means that the lower temperature limit $T_{minus}$ is 20%, which corresponds to a speed V=3,000 sheets/hour at an identical coloration of 30%. The upper temperature limit $T_{plus}$ accordingly is 30%, which corresponds to a target speed $V_{Soll}$=9,000 sheets/hour at a 30% coloration. This means that the minimum acceptable speed $V_{min}$ is 3,000 sheets/hour and the maximum acceptable speed is $V_{max}$=9,000 sheets/hour. The actual speed $V_{lst}$ is 6,000 sheets/hour, the target speed $V_{Soll}$ is 12,000 sheets/hour. Thus the control computer 15 may immediately accelerate the printing press 1 to V=9,000 sheets/hour and then more slowly along the tolerance limit T=30% to V=12,000 sheets/hour. When the target speed $V_{Soll}$=12,000 sheets/hour is reached, the inking unit 14 continues to be heated up by the temperature control circuit 16 to the optimum temperature T of 35% for a speed V=12,000 sheets/hour.

Figure 6:
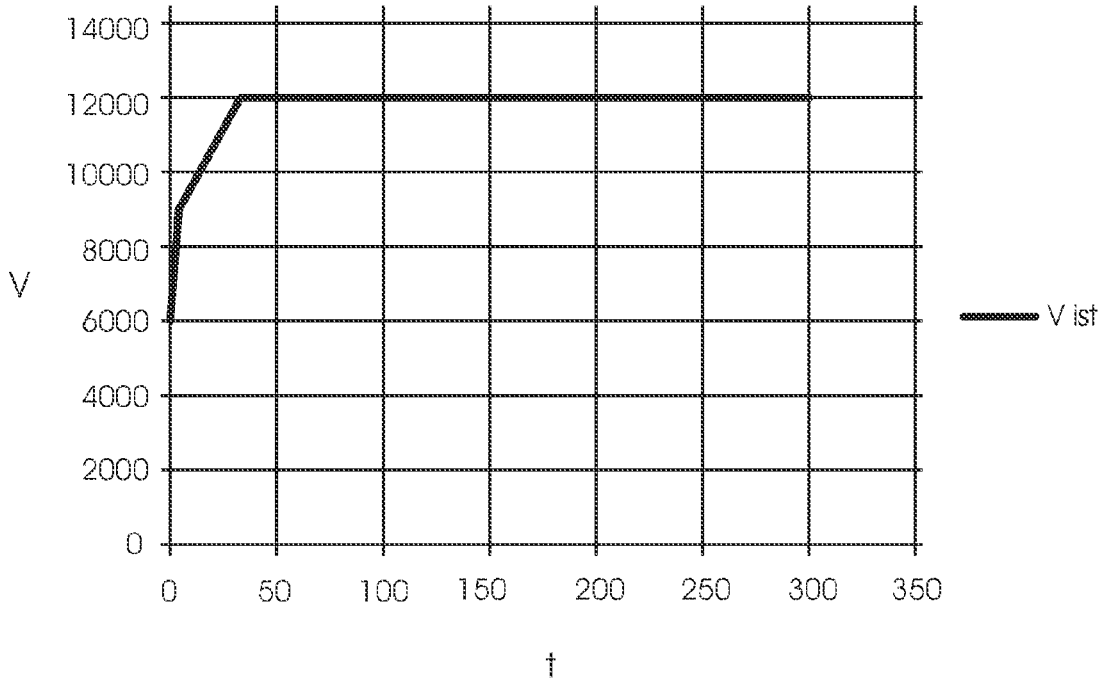
FIG. 6 is a graph for illustrating a progression of the printing speed as a function of time when the printing speed is increased from 6,000 to 12,000 sheets per hour with identical coloration.

FIG. 6 illustrates the progression of the speed $V_{lst}$ as a function of the time t when the press 1 is accelerated from 6,000 to 12,000 sheets/hour. The chart shows that initially, the printing press 1 accelerates very quickly to 9,000 sheets/hour. Then it accelerates more slowly along the tolerance limit at a second acceleration to a speed of 12,000 sheets/hour.

Figure 7:
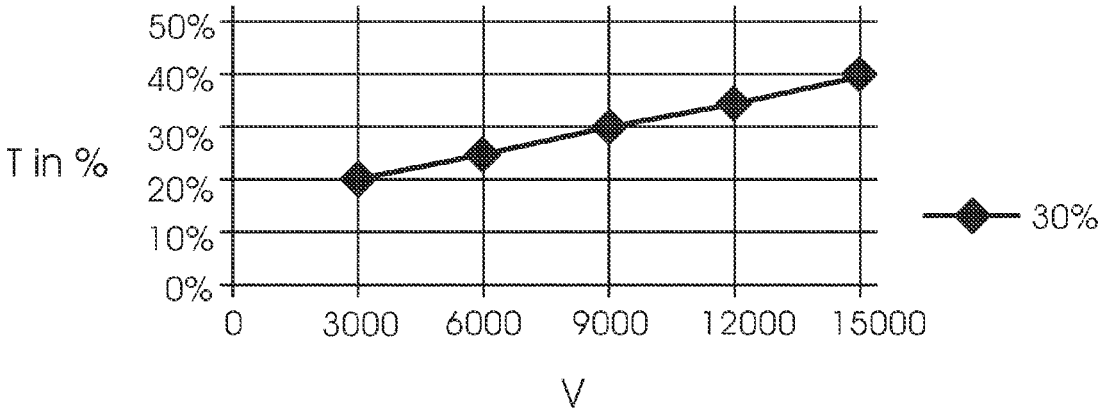
FIG. 7 is a graph for illustrating the relationship between temperature and printing speed when the printing speed is increased from 6,000 to 8,000 sheets per hour with identical coloration.
Figure 8:
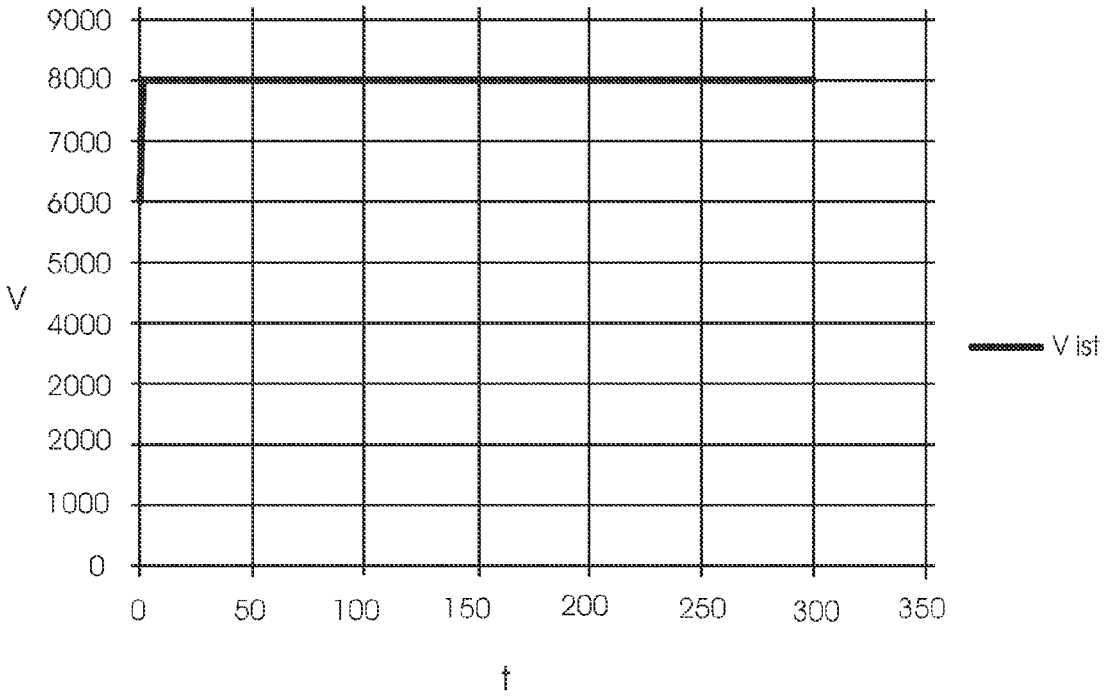
FIG. 8 is a graph for illustrating the progression of the speed as a function of time when the printing speed is increased from 6,000 to 8,000 sheets per hour with identical coloration.

FIG. 7 illustrates a second example, in which the printing press 1 is accelerated from a printing speed $V_{lst}$=6,000 sheets/hour to a speed $V_{Soll}$=8,000 sheets/hour. Again, the target coloration is predetermined at 30%, temperature $T_{lst}$ is 25% at the speed $V_{lst}$, and the temperature tolerance limit is 5%. This means that the lower limit $T_{minus}$ is 20% and thus $V_{min}$ is 3,000 sheets/hour. The upper limit $T_{plus}$ is 30%, which corresponds to a maximum speed $V_{max}$ of 9,000 sheets/hour. Since the target speed $V_{Soll}$=8,000 sheets/hour is below the maximum speed $V_{max}$=9,000, the printing press 1 may immediately be accelerated to the target speed $V_{Soll}$=8,000 sheets/hour. When $V_{Soll}$=8,000 sheets/hour is reached, the inking unit 14 continues to be heated up until the target temperature $T_{Soll}$=28, 5% is reached. FIG. 8 again illustrates the progression of the speed V as a function the time t. As can be seen, the printing press 1 may immediately be accelerated from 6,000 sheets/hour to 8,000 sheets/hour in one step.

Figure 9:
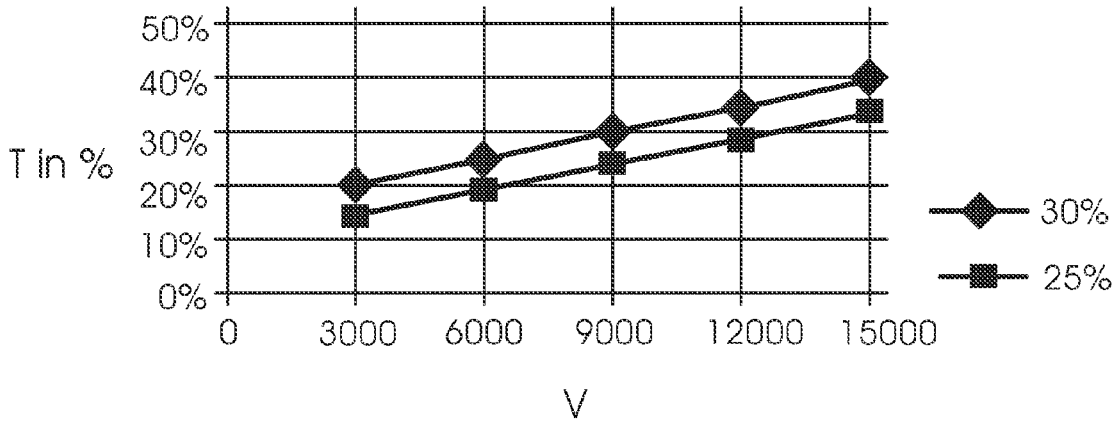
FIG. 9 is a graph for illustrating an increase of the printing speed from 6,000 to 12,000 prints per hour with reduced coloration.
Figure 10:
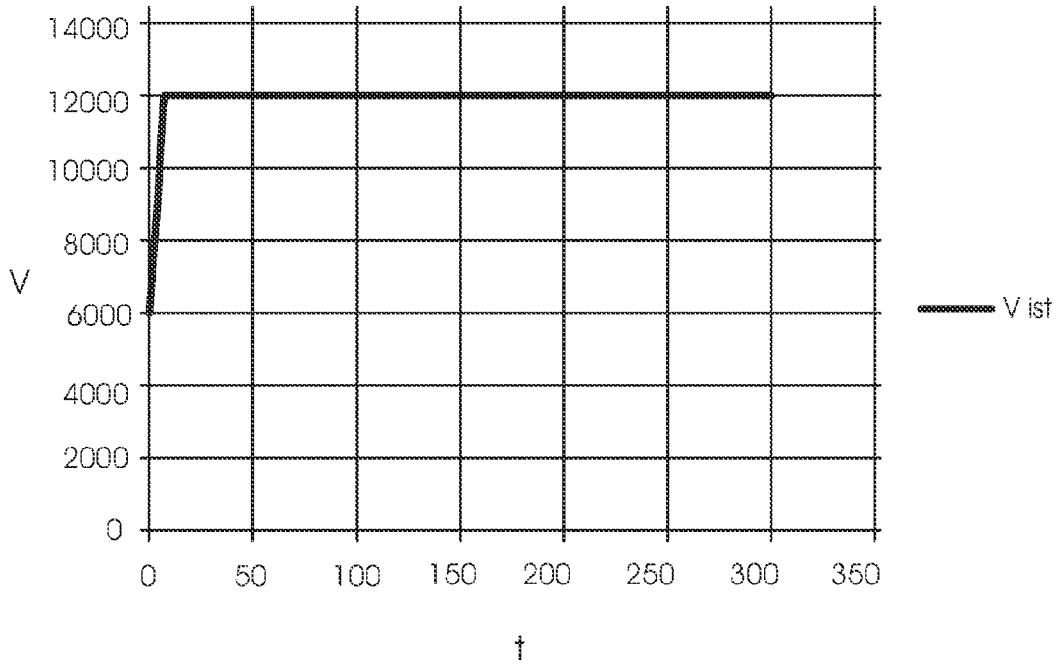
FIG. 10 is a graph for illustrating the speed progression as a function of time when the printing speed is increased from 6,000 to 12,000 sheets per hour with reduced coloration.

A further example of a speed change is shown in FIG. 9. In FIG. 9, the printing speed $V_{lst}$=6,000 sheets/hour is to be increased to $V_{Soll}$=12,000 sheets/hour. At $V_{lst}$=6,000 sheets/hour, the actual coloration value is 30%. This value is to be reduced to 25% at a target speed $V_{Soll}$ of 12,000 sheets/hour. At a target coloration of 30%, the temperature $T_{lst}$ is 25%; again the tolerance limits are 5%. The progression illustrated in FIG. 9 shows that the lower limit $T_{minus}$=20% leads to $V_{min}$=6,000 sheets/hour at the target coloration of 25%. The upper limit $T_{plus}$=30% corresponds to $V_{max}$=12,000 sheets/hour at a target coloration of 25%. This means that $V_{max}$=$V_{Soll}$=12,000 sheets/hour. Thus again in this example the press 1 can immediately be accelerated to V=12,000 sheets/hour. Due to the target coloration change to a lower value, the present case permits an acceleration in a single quick step even through the printing speed V is doubled. When the target speed $V_{Soll}$=12,000 sheets/hour is reached, the inking unit 14 continues to be heated up until a temperature T=30% is reached.

Figure 11:
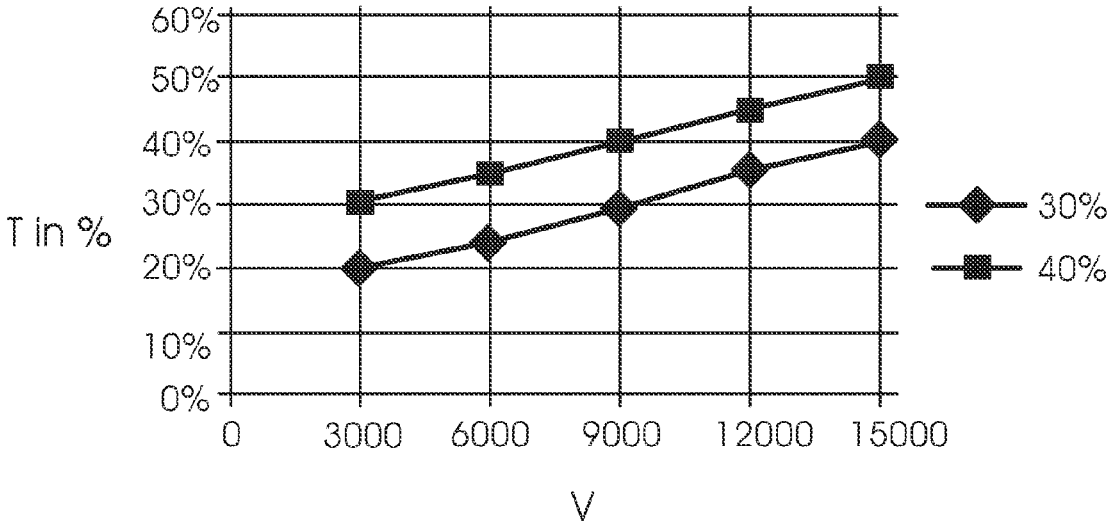
FIG. 11 is a graph for illustrating the relationship between temperature and printing speed when the printing speed is increased from 6,000 to 12,000 sheets per hour with increased coloration.
Figure 12:
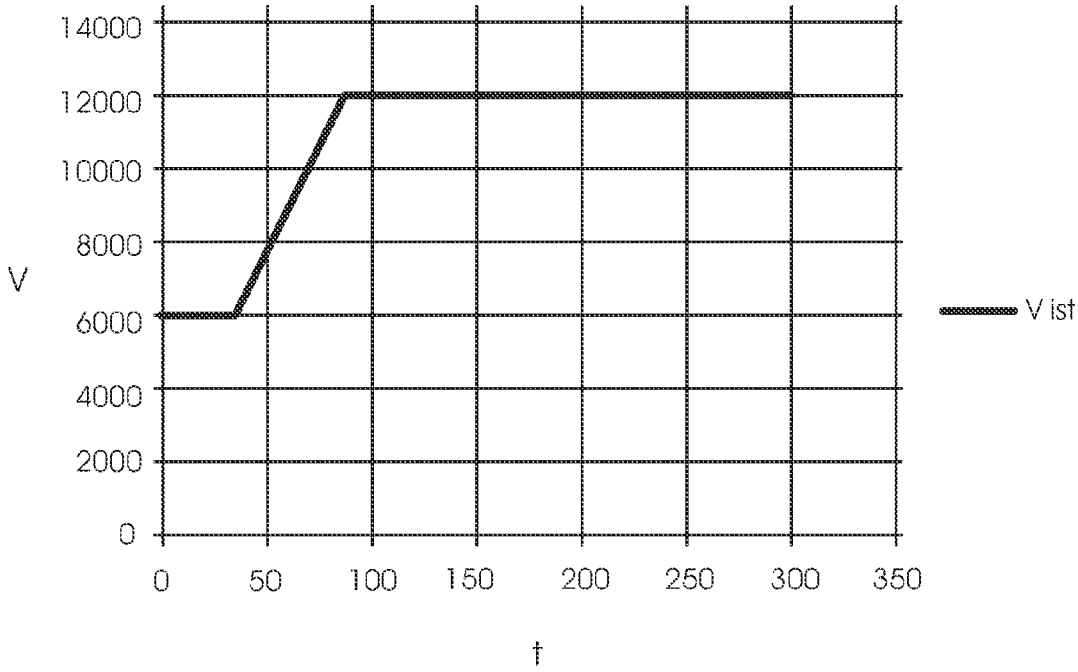
FIG. 12 is a graph for illustrating the relationship between printing speed and time when the printing speed is increased from 6,000 to 12,000 sheets per hour with increased coloration.

FIG. 11 illustrates a further example of a speed change. Again, the printing speed is to be increased from $V_{lst}$=6,000 sheets/hour to $V_{Soll}$=12,000 sheets/hour. At $V_{lst}$=6,000 sheets/hour the target coloration is 30%, at $V_{Soll}$=12,000 sheets/hour, however, the target coloration is 40%. Again, at $V_{lst}$=6,000 sheets/hour $T_{lst}$ is 25%, the tolerance limit dT is 5%. FIG. 11 shows that $V_{min}$ is zero at the lower tolerance limit $T_{minus}$=20% and at the target coloration of 40%. At the upper limit $T_{plus}$=30%, $V_{max}$ is 3,000 sheets/hour. This means that at first, the press 1 needs to remain at a speed V=6,000 sheets/hour until the inking unit 14 has been heated up to a temperature T=30%. Then the printing speed V is slowly increased along the tolerance limits to accelerate the press 1 to a speed V=12,000 sheets/hour. When $V_{Soll}$=12,000 sheets/hour is reached, the printing press 1 again needs to be heated even further until a temperature T=$T_{Soll}$=45% is reached. The associated speed progression V(t) is shown in FIG. 12.

Figure 13:
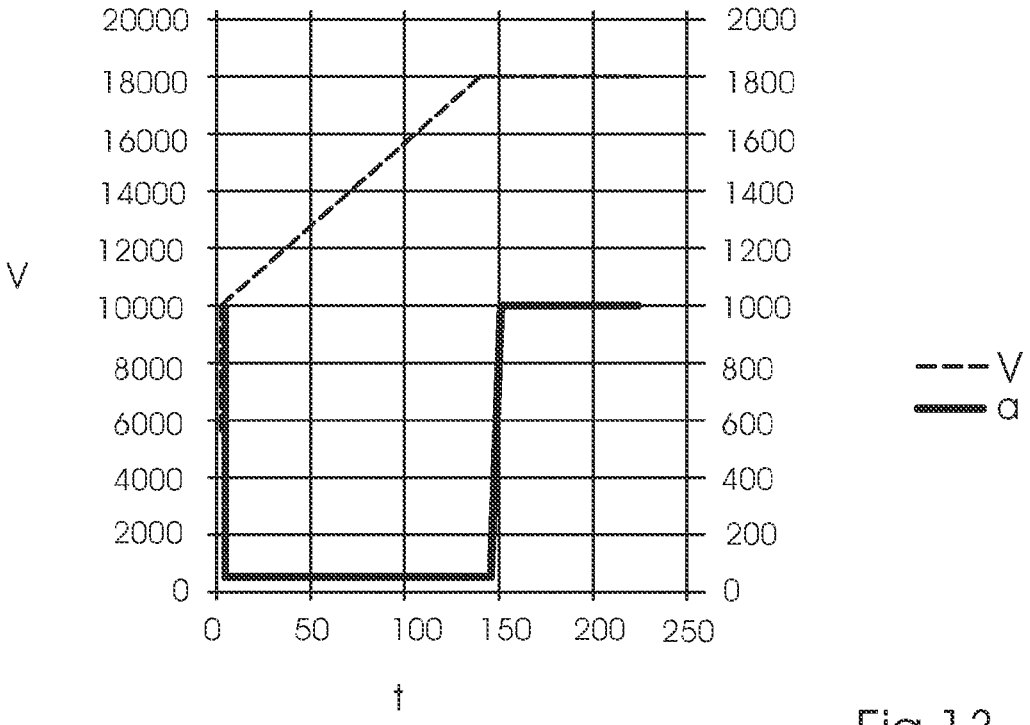
FIG. 13 is a graph for illustrating the progression of the printing speed over time and the acceleration over time when the printing speed changes from 10,000 to 18,000 sheets per hour.
Figure 14:
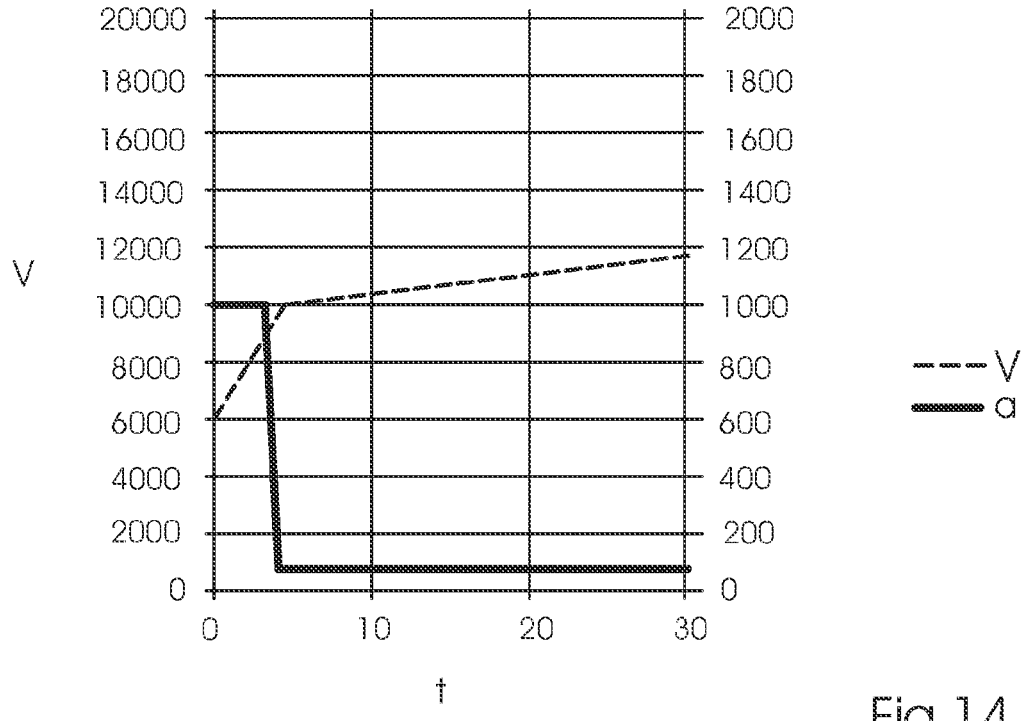
FIG. 14 is a graph for illustrating speed and acceleration as a function of time when the printing speed is increased from 10,000 to 12,000 prints per hour.
Figure 15:
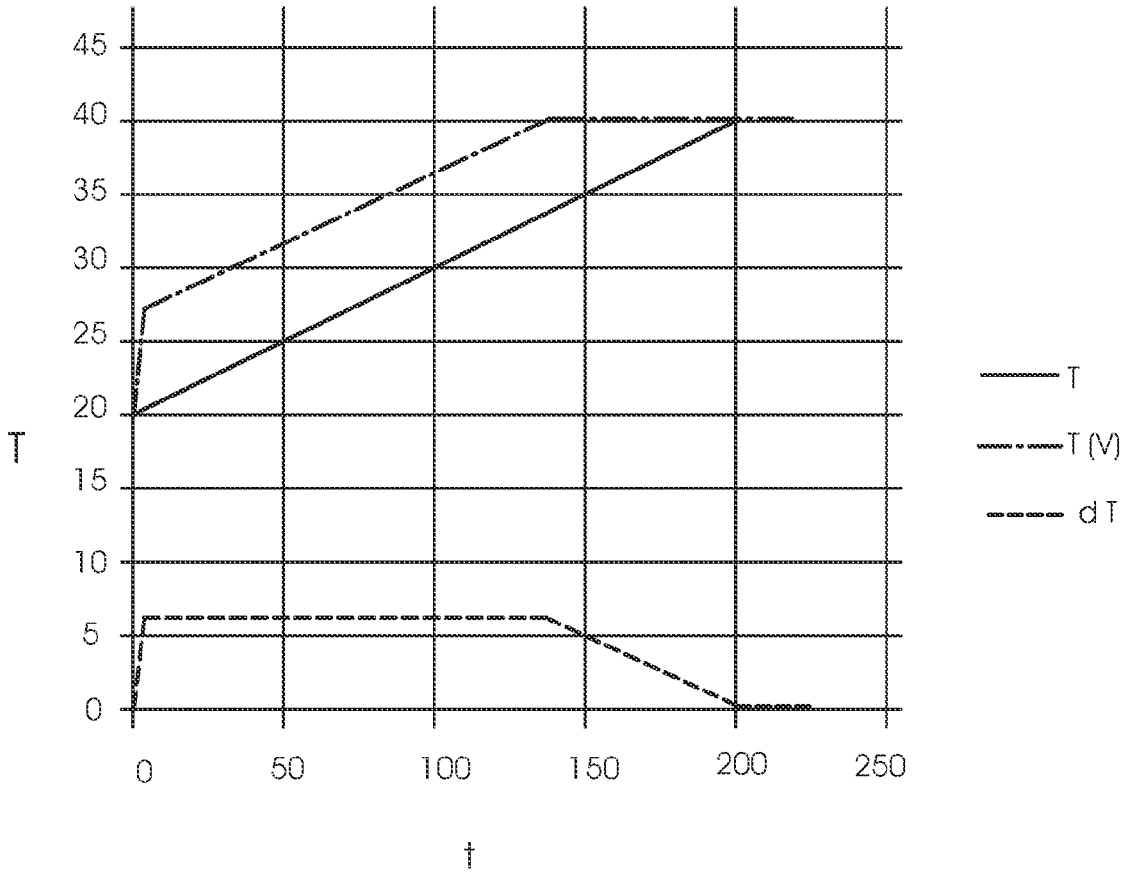
FIG. 15 is a graph for illustrating the progression of the temperature as a function of time with a maximum acceptable temperature difference of 6%.

FIG. 13 illustrates the printing speed progression V(t) and the acceleration a(t) at a given constant acceleration a. FIG. 14 illustrates the progression of the printing speed V(t) and of the acceleration a(t). It can be seen that to remain below the tolerance limits, acceleration a needs to be changed when a printing speed $V_{lst}$=10,000 sheets/hour is reached. FIG. 15 illustrates the progression of the temperature T, of the target temperature T(V) and of the temperature difference dT. The tolerance limit dT is shown to be at 6%. This tolerance limit is respected each time the temperature T is changed.

The invention claimed is:

1. A method of controlling a printing speed and a temperature of a printing press to attain a predetermined actuating variable, the printing press having a control computer, which comprises the steps of:

calculating a target temperature to attain the predetermined actuating variable at a desired printing speed;

initiating adjusting operations to attain the target temperature by means of the control computer, the adjusting operations including:

changing an actual printing speed via a first acceleration within tolerance limits relating to fluctuations about the predetermined actuating variable;

stopping the first acceleration if the desired printing speed is reached;

changing the first acceleration if a tolerance limit is reached and the desired printing speed has not yet been attained; and running the printing speed along the tolerance limits at a modified second acceleration until the desired printing speed is reached.

2. The method according to claim 1, which further comprises calculating the modified second acceleration in dependence on a current deviation of an actual value from the predetermined actuating variable.

3. The method according to claim 2, which further comprises continuously adapting the modified second acceleration to a difference between the actual value and the predetermined actuating variable.

4. The method according to claim 1, wherein if the tolerance limits have already been exceeded at a start of a printing speed change, a printing speed is initially maintained by the control computer until the tolerance limits are met again, and a printing speed change is not implemented until then.

5. The method according to claim 1, wherein the predetermined actuating variable is a predetermined target coloration and the fluctuations are coloration fluctuations.

6. The method according to claim 5, which further comprises choosing the tolerance limits to ensure that when the tolerance limits are reached, there are just not yet any visible coloration fluctuations.

7. The method according to claim 5, which further comprises choosing the tolerance limits to ensure that only color fluctuations occur that are just tolerable.

8. The method according to claim 1, which further comprises taking into account characteristics of the printing press, characteristics of a used printing ink and of a printing material by the control computer when calculating at least one of the first or second accelerations and the desired printing speed.

9. The method according to claim 1, wherein at least one of the first acceleration or the modified second acceleration is constant.

10. The method according to claim 1, wherein at least one of the first acceleration or the modified second acceleration is changed in steps by the control computer.

* * * * *